US005213317A

United States Patent [19]

Mandel et al.

[11] Patent Number: 5,213,317

[45] Date of Patent: May 25, 1993

[54] MODULAR BINDING APPARATUS WITH ROTATING TRANSPORT

[75] Inventors: Barry P. Mandel, Fairport; George J. Roller, Penfield; Joseph J. Ferrara, Webster; Venkatesh H. Kamath, Fairport; William Brant, Rochester; Louis J. Bressler, Webster; John R. Falvo; Karl M. Kau, both of Rochester, all of N.Y.

[73] Assignee: Xerox Corporation, Stamford, Conn.

[21] Appl. No.: 826,506

[22] Filed: Jan. 27, 1992

[51] Int. Cl.[5] ..... B42B 2/00; G03G 21/00

[52] U.S. Cl. ..... 270/53; 355/324

[58] Field of Search ..... 270/53, 58; 412/8, 33, 412/34, 36, 41; 355/324

[56] References Cited

U.S. PATENT DOCUMENTS

| | | | |
|---|---|---|---|
| 2,645,327 | 7/1953 | Hildmann | 412/33 X |
| 3,715,260 | 2/1973 | Dornemann et al. | 412/36 X |
| 3,804,694 | 4/1974 | Blair | 412/34 X |
| 3,953,277 | 4/1976 | Kuhns | 412/11 X |
| 4,361,393 | 11/1982 | Noto | 270/58 X |
| 4,782,363 | 11/1988 | Britt et al. | 270/53 X |
| 4,828,645 | 5/1989 | Van Bortel | 56/384 |
| 4,878,656 | 11/1989 | Honjo et al. | 270/53 |
| 4,958,974 | 9/1990 | Schenk | 412/34 X |
| 5,140,380 | 8/1992 | Nakamura et al. | 270/53 X |
| 5,141,215 | 8/1992 | Ishiguro et al. | 270/53 |

*Primary Examiner*—Edward K. Look
*Assistant Examiner*—John Ryznic
*Attorney, Agent, or Firm*—H. Fleischer; J. E. Beck; R. Zibelli

[57] ABSTRACT

An apparatus which adhesively binds a set of sheets by applying a strip having an adhesive to one surface thereof to the spine of the set. The apparatus includes a compiling station which holds at least one set of sheets. A transport advances the set of copy sheets from the compiling station to the bind and to a receiving station. The transport is movable from a non-operative position, coupling the compiling station to the receiving station, to an operative position coupling the compiling station to the binder. In addition, there is a manual insertion station located at the operative position enabling a set of sheets to be inserted into the transport when the transport is positioned in the operative position. The transport is then adapted to advance the manually inserted set of sheets to the binder which then binds the manually inserted set of sheets to one another.

16 Claims, 12 Drawing Sheets

MODULAR BINDING APPARATUS WITH ROTATING TRANSPORT

The apparatus relates generally to an electrophotographic printing machine, and more particularly concerns an apparatus for adhesively binding sets of finished copy sheets to one another.

In a typical electrophotographic printing process, a photoconductive member is charged to a substantially uniform potential so as to sensitive the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to the carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a high speed commercial printing system of the foregoing type, the copy sheets with the information permanently affixed thereto, are transported to a finishing station. After the requisite number of sheets, corresponding to a set of original documents, is compiled in the finishing station, the copies of the set are permanently affixed to one another to form a booklet thereof. Most frequently, a stapling apparatus is employed to secure the sheets to one another to form such a booklet. However, other alternative techniques have been used such as adhesively binding the sheets to one another. In order for each set of copy sheets to have a bound finished appearance, it is desirable to adhesively secure the sheets of the set to one another. Often, the printing machine employs a recirculating document handling system to advance successive original documents from a stack thereof to the exposure station of the electrophotographic printing machine for reproduction. When a recirculating document handling system is employed, the printing system produces a large number of copies rapidly. This type of system may be used to form sets or booklets of copy sheets. The copy sheets are collected and adhesive is applied to the spine to bind the sheets together into sets of copy sheets. The adhesively bound sets of copy sheets are then stacked for presentation to the machine operator. Numerous methods are known in the art for adhesively securing sheets to one another. For example, a liquid adhesive may be applied to the spine of a moving set of copy sheets, or the copy sheets may be stationary and a container having a supply of adhesive therein may be moved along the spine to apply the adhesive thereto. Alternatively, a tape having an adhesive on one surface thereof may be positioned in contact with the spine and heat applied thereto so as to cause the adhesive to flow between the sheets in the region of the spine securing the sheets together. It is clear that it is desirable to adhesively bind the sheets of a set of copy sheets to one another. Frequently, an electrophotographic printing machine does not possess a binding apparatus. Thus, it is desirable to be capable of employing a modular binding apparatus which may be moved to the printing machine and inserted therein in an operative relationship therewith. For example, it is desirable to be capable of docking the binding module adjacent the compiling station of the printing machine and, thereafter, positioning the elevator and catch trays after the binding module so as to receive bound sheets thereat. It is also desirable to be capable of manually inserting sets of sheets to be bound in addition to those sets of sheets being advanced from the printing machine. Various approaches have been devised for applying the adhesive to the spine of the set of copy sheets. The following disclosure arrears to relevant:

U.S. Pat. No. 4,828,645, patentee: VanBortel, issued: May 9, 1989.

The relevant portions of the foregoing patent may be briefly summarized as follows:

U.S. Pat. No. 4,828,645 describes an apparatus which adhesively binds a set of sheets by applying a strip having an adhesive on one surface thereof to the spine of the set. This strip is supported on a heated platen which softens the adhesive. The spine of the set of copy sheets is pressed into the adhesive on the strip. The depth of penetration of the spine into the adhesive is controlled so as to form a layer of adhesive between the spine and the strip having a predetermined thickness.

In accordance with one aspect of the present invention, there is provided an apparatus for securing sheets of a set of sheets to one another. The apparatus includes a compiling station holding at least one set of sheets. Means are provided for binding the sheets of the set of sheets to one another. Means advance the set of sheets from the compiling station to the binding means. The advancing means is movable from an operative position, coupling the compiling station to the binding means, to a nonoperative position, de-coupling the compiling station from the binding means.

Pursuant to another aspect of the features of the present invention, there is provided an electrophotographic printing machine of the type in which successive copy sheets are compiled into sets and the sheets of each set are bound together. The improvement includes a compiling station holding at least one set of copy sheets. Means are provided for binding the copy sheets of the set of copy sheets to one another. Means advance the set of copy sheets from the compiling station to the binding means. The advancing means is movable from an operative position, coupling the compiling station to the binding means, to a nonoperative position, de-coupling the compiling means from the binding means.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
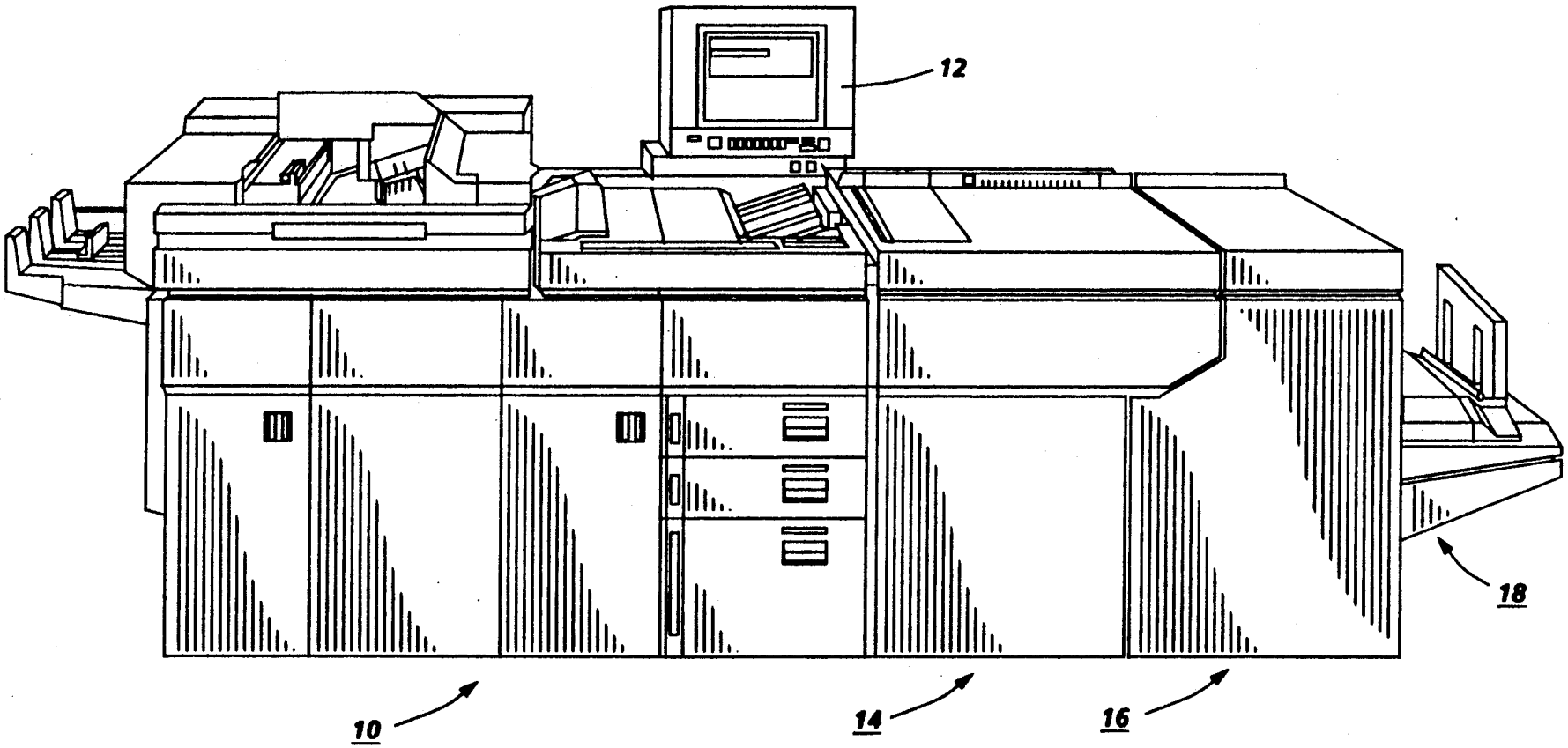
FIG. 1 is a perspective view of an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts an electrophotographic printing machine incorporating the features of the present invention therein. It will become evident from the following discussion that the binding apparatus of the present invention may be utilized in a wide variety of printing machines and is not necessarily specifically limited in this application to the particular embodiment depicted herein.

Referring now to FIG. 1, there is shown an electrophotographic printing machine, indicated generally by the reference numeral 10, composed of a plurality of programmable components and subsystems which cooperate to carry out the copying job programmed through a touch dialogue user interface on the display touch screen 12. The process copy sheets are advanced from printing machine 12 to a compiler module, indicated generally by the reference numeral 14. Compiler module 14 forms a set of copy sheets which are subsequently advanced to the binding module, indicated generally by the reference numeral 16. A bound set of copy sheets are advanced from binding module 16 to the receiving station, indicated generally by the reference numeral 18, for removal therefrom by the machine operator.

Figure 2:
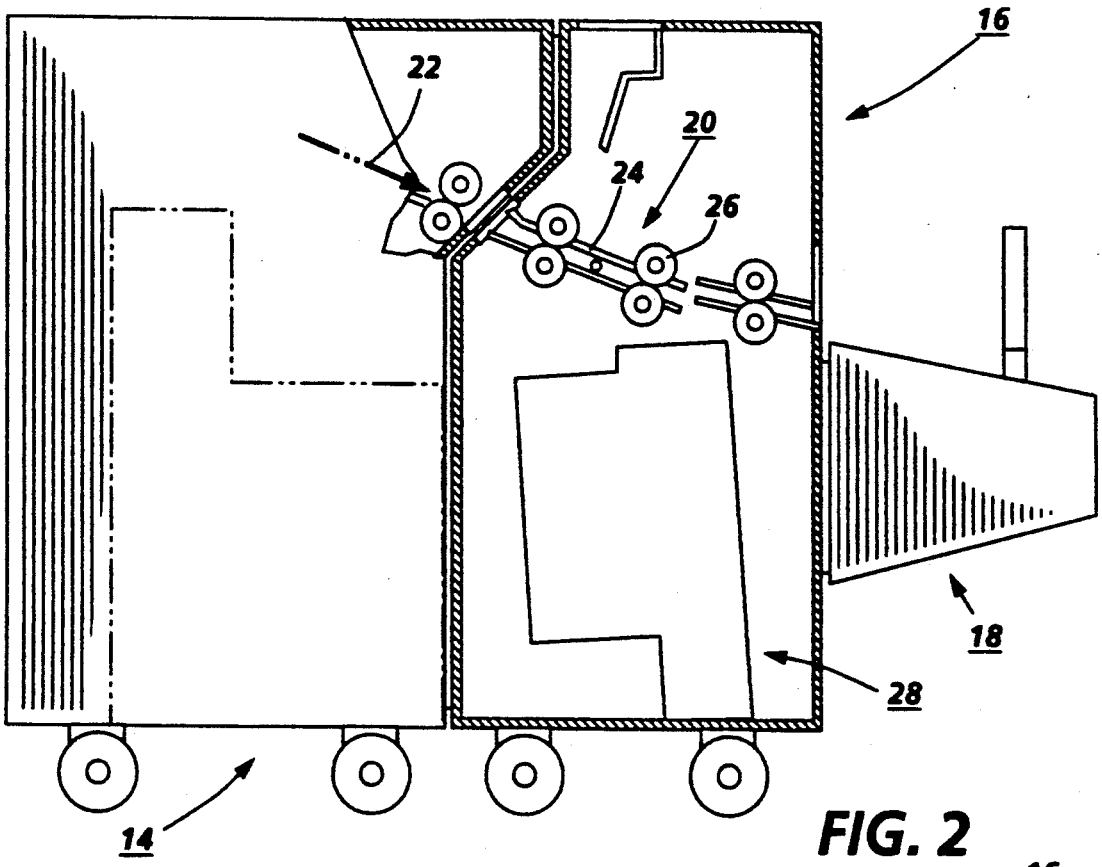
FIG. 2 illustrates one embodiment of the transport of the binding apparatus receiving the set of sheets from the compiling station.

Turning now to FIG. 2, there is shown binder 16 in greater detail. As depicted thereat, transport 20 is adapted to receive a set of copy sheets advancing in the direction of arrow 22 from compiler 14. Transport 20 includes plates 24 and drive rollers 26. Plates 24 are movable towards one another to clamp the set of copy sheets therebetween. After the set of copy sheets is advanced and received by transport 20, transport 20 pivots into a substantially vertical position for advancing the sheet into the binder, indicated generally by the reference numeral 28. The foregoing is shown more clearly in FIG. 3.

Figure 3:
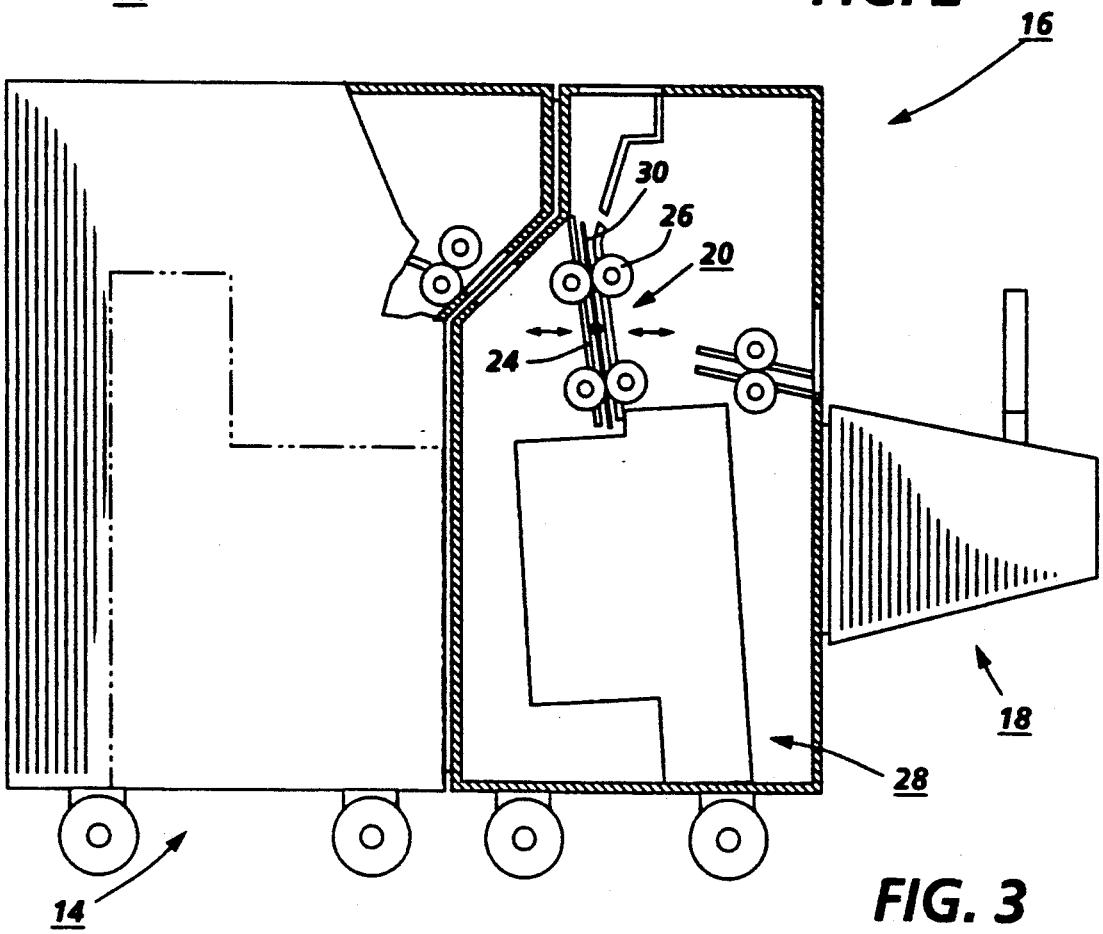
FIG. 3 shows the FIG. 2 transport pivoting to advance the set of sheets received from the compiling station to the binding apparatus.

Turning now to FIG. 3, there is shown transport 20 positioned in a substantially vertical orientation with plates or clamps 24 holding a set of sheets 30 therebetween. After the set of sheets have been bound to one another, transport 20 pivots to the position shown in FIG. 4 and ejects the set of bound sheets onto receiving station 18 for removal therefrom by the machine operator.

Figure 4:
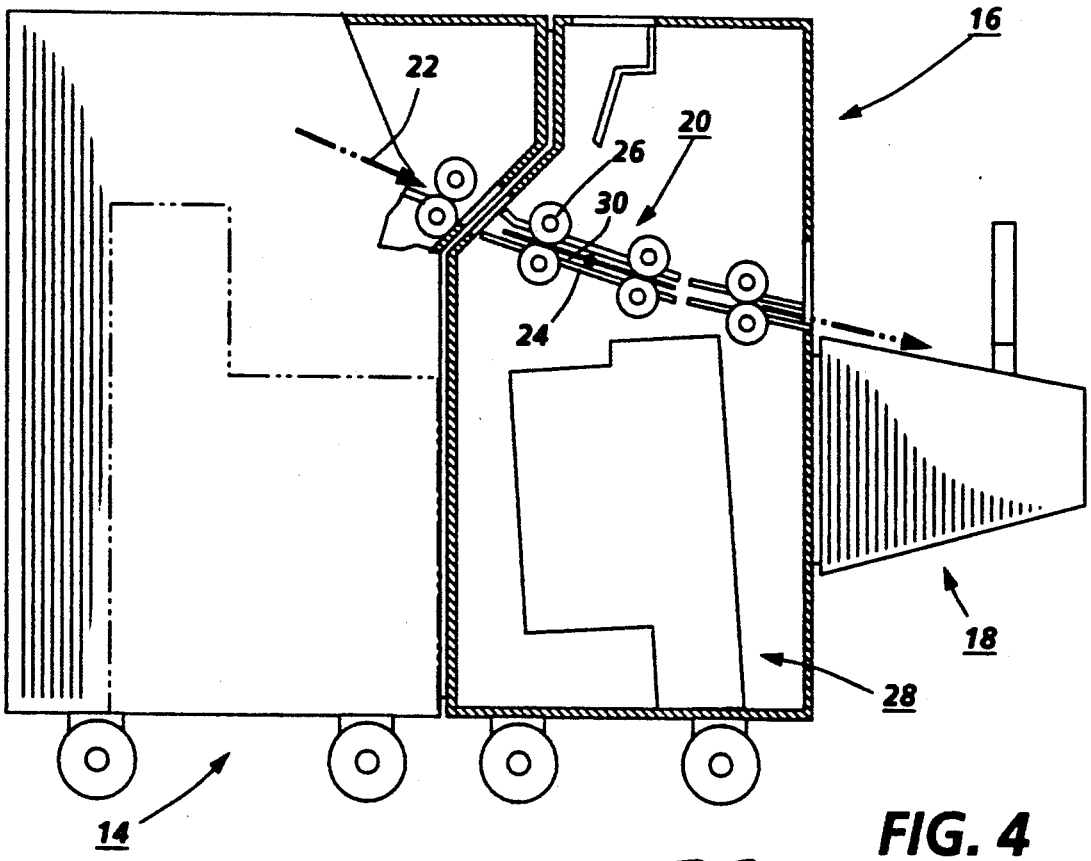
FIG. 4 shows the FIG. 2 transport in the non-binding or bypass mode wherein the set of sheets is advanced from the compiling station directly to the catch tray without entering the binding apparatus.

Referring now to FIG. 4, there is shown transport 20 in the non-binding mode of operation. As depicted thereat the compiled set of sheets 30 advances in the direction of arrow 22 from compiling station 14 to binding unit 16. In binding unit 16, the set of copy sheets 30 is received by transport 20. At this time, the plates 24 do not move towards one another to clamp the sheets, but rather, rollers 26 advance the set of sheets to receiving station 18. In this way, a set of non-bound sheets may be advanced from the compiling station through the binding station to the receiving station for removal therefrom by the machine operator.

Figure 5:
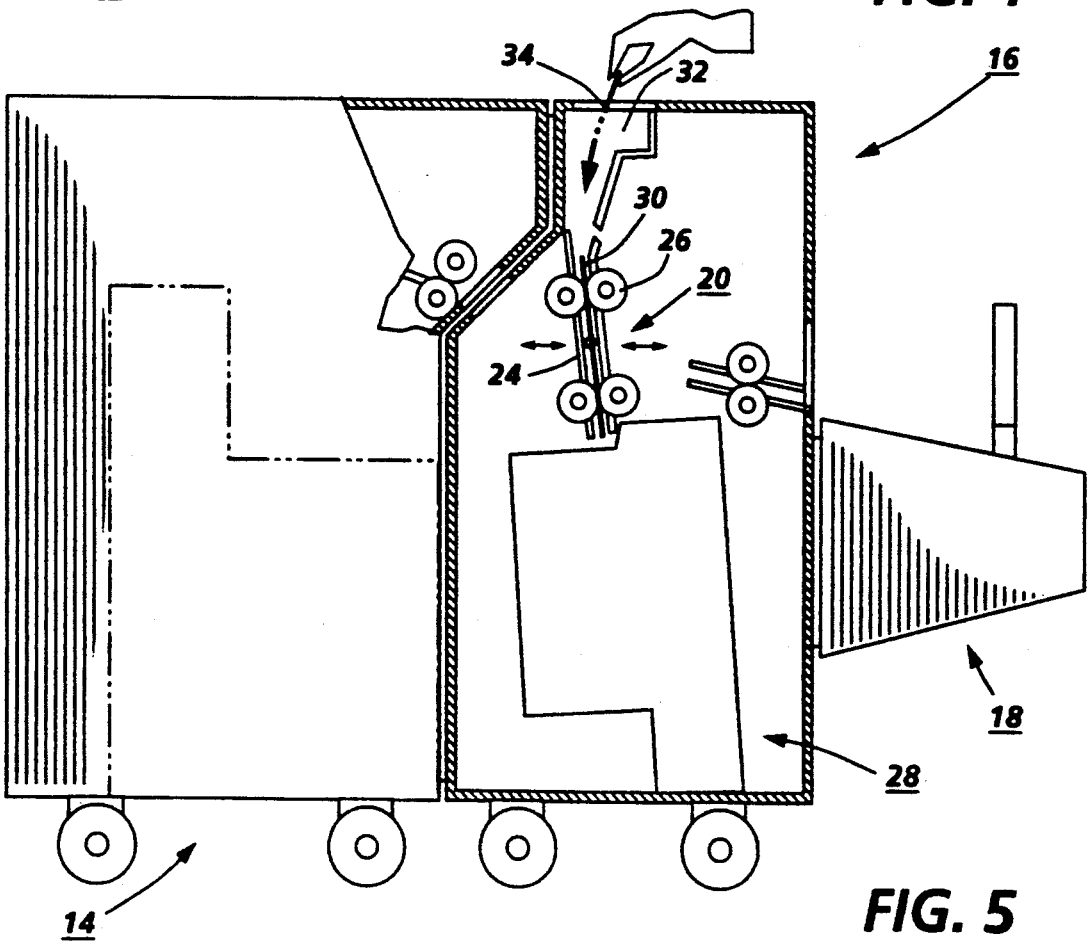
FIG. 5 depicts the FIG. 2 transport in the manual binding mode.
Figure 6:
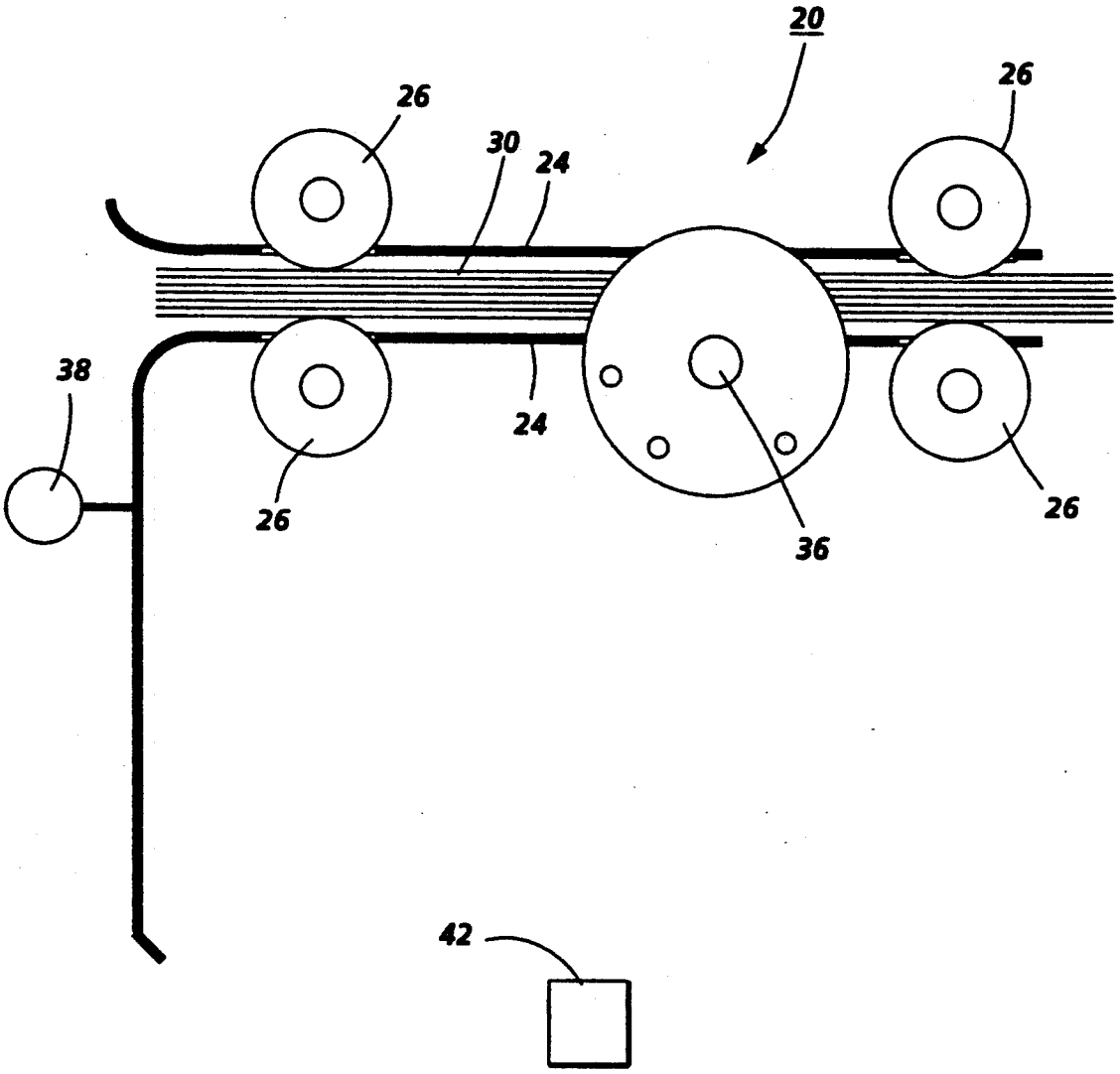
FIG. 6 is schematic elevational view showing a set of copy sheets being received in the binding apparatus.

Referring now to FIG. 5, there is shown transport 20 pivoted to a substantially vertical direction. One end of transport 20 is adjacent binder 28. The other end of transport 20 is adjacent a manual insertion station 32. In this mode, the machine operator places a set of copy sheets in the manual insertion station 32 as shown by arrow 34. The lead edge of the set of copy sheets is positioned adjacent transport 20 so as to be received thereby. Transport 20 advances the set of copy sheets until all of the copy sheets are disposed therein. At that time, plates 24 move toward one another to secure the set of sheets for movement into binder 28. After the set of copy sheets have been bound to one another, transport 20 pivots to the position shown in FIG. 2 and the bound set of copy sheets is advanced to receiving station 18 for subsequent removal therefrom by the machine operator. Turning now to FIG. 6, there is shown binding apparatus in greater detail. As depicted thereat, the set of copy sheets is advanced from the compiler by rollers 26 between plates 24. After the set of copy sheets 30 is positioned between plates 24, plates 24 move toward one another to clamp the set of copy sheets therebetween. Plates 24 are mounted on a pivoting shaft 36. The clamping action of plates 24 is numatically driven through a solenoid or other motor driven. Shaft 36 permits plates 24 to rotate from a horizontal position to a vertical position and vice versa. When the bind feature is selected in the printing machine, a 120 volt AC bidirectional motor 38 pivots transport 20 from the horizontal position to the vertical position. When the set of copy sheets 30 have been pivoted from the horizontal position to the vertical position, the set of sheets are positioned for registration as shown in FIG. 7.

Figure 7:
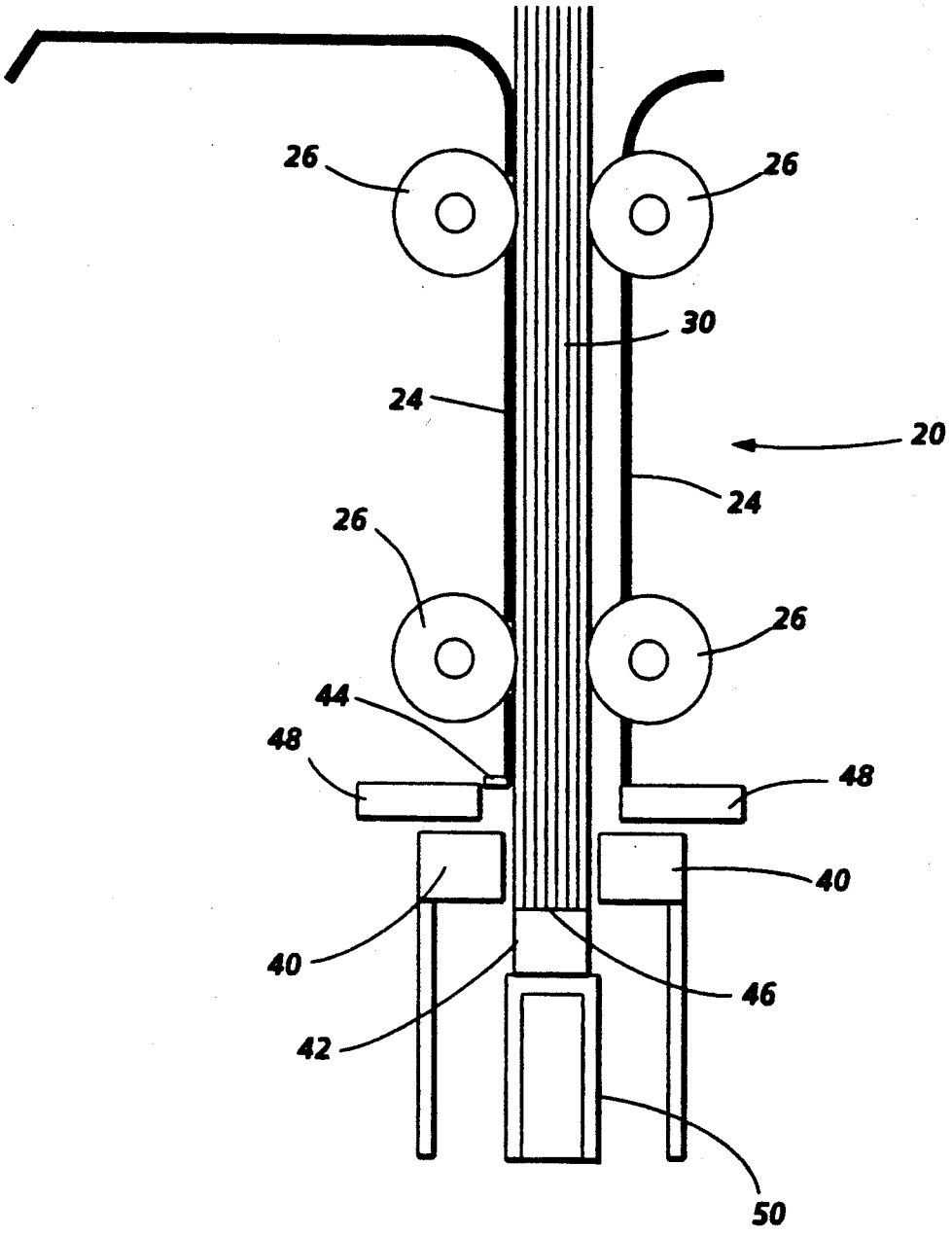
FIG. 7 is a schematic elevational view depicting the set of copy sheets being vibrated in the binding apparatus to register the edges thereof.

Referring now to FIG. 7, transport 20 is shown in the vertical position. When transport 20 is in the vertical position, the two binder flaps 40, on either side of binder head 42, move in an upwardly direction to form a channel, or U-shaped opening. Transport 20 is moved in a downward direction until the lower portion thereof engages a mechanical stop 44. A sensor, preferably a light emitting diode and photodiode, detect the presence of transport 20 against stop 44 and de-energizes the motor moving the transport in a downwardly direction.

Mechanical stop 44 is preferably a pin mounted vertically movable so as to be adjustable from a first position for holding transport 20 during set registration to a second position, further from the surface of binder platen 42 for set binding. After transport 20 engages stop 44, in the first position, the set of copy sheets is positioned in the U-shaped opening with edge 46 thereof abutting bind head 42. At this time, plates 24 of transport 20 open, i.e. move away from one another. Bind head 42 is a platen having a generally planar surface onto which the set of copy sheets is registered and which is internally heated for the binding process. Platen 42, located between flappers 40, serves as a thick surface for registering the set of copy sheets, and as a source as heat for activating the glue on the adhesive tape when binding the set spine. Teflon is coated on the upper surface of platen 42 to reduce sticking of the tape thereto. The platen has two grooves extending from one side to the other side thereof. These grooves are located under the ends of the tape during the spine binding step to provide an air gap that limits the amount of the heat transferred to the tape. This structure prevents molten glue from flowing from the ends of the tape producing an undesirable appearance defect. The platen also has four side protrusions which prevent sheets from falling between the flappers and the platen during registration. Flappers 40 limit set spreading during registration, form the flaps in the adhesive tape during folding of the adhesive tape flaps or sides, and press and heat the tape flaps onto the top and bottom sheets or covers of the set of copy sheets. The flappers are moved by cams driven by 120 volt AC unidirectional motor connected to a cam shaft. At the start of each cycle, the cams rotate for a segment to drive the flappers up for set registration and then drive the flappers down when registration is completed. During the next of segment of cam rotation, the cam raises the flappers up. Springs attached to the cam arms, pull the flappers in to press the sides of the adhesive tape against the outermost sheets of the set for binding. The flappers also pivot the spring loaded tape guards out of the way. Another set of cams changes the path of the flap is when opening from a bound set. The high point of these cams push up on a follower which raises the flappers away from the bound set to break any seal between the heated flappers and the set. Platen 42 and flappers 40 each have an internally resistive AC powered heating element. Thermistors are used to monitor the operating temperature of the platen and flappers. Calipers 48 are air actuated paper clamps mounted above the flappers. The calipers are used to straighten the set of copy sheets at the completion of registration and during the spine bind cycle. Air pressure presses the calipers against the set of copy sheets while the set is in contact the adhesive tape during the bind operation and before the flappers are raised for binding the tape to the set sides in order to reduce flaring of sheets near the binding edge. A vibrator, indicated generally by the reference numeral 50, is attached to the underside of platen 42. Vibrator 50 includes an AC power supply which drives a solenoid coupled to platen 42. Vibrator 50 vibrates platen 42 at two frequencies for two levels of vibration force. When the set of copy sheets is initially positioned in contact with platen 42, vibrator 50 vibrates platen 42 at full force, i.e. 50 volts and 60 hertz. For the remainder of the registration cycle, the set of copy sheets is vibrated at half force, i.e. at 100 volts and 120 hertz. After registration of the copy sheets is completed, plates 24 of transport 20 close and transport 20 moves in a vertically upward direction to space edge 46 of set 30 from platen 42 and a tape 52 having adhesive on one surface thereof is interposed between platen 42 and spine 46 of set 30. The surface of the tape having the adhesive thereon is positioned to contact the spine of the set of copy sheets. This is shown more clearly in FIG. 8.

Figure 8:
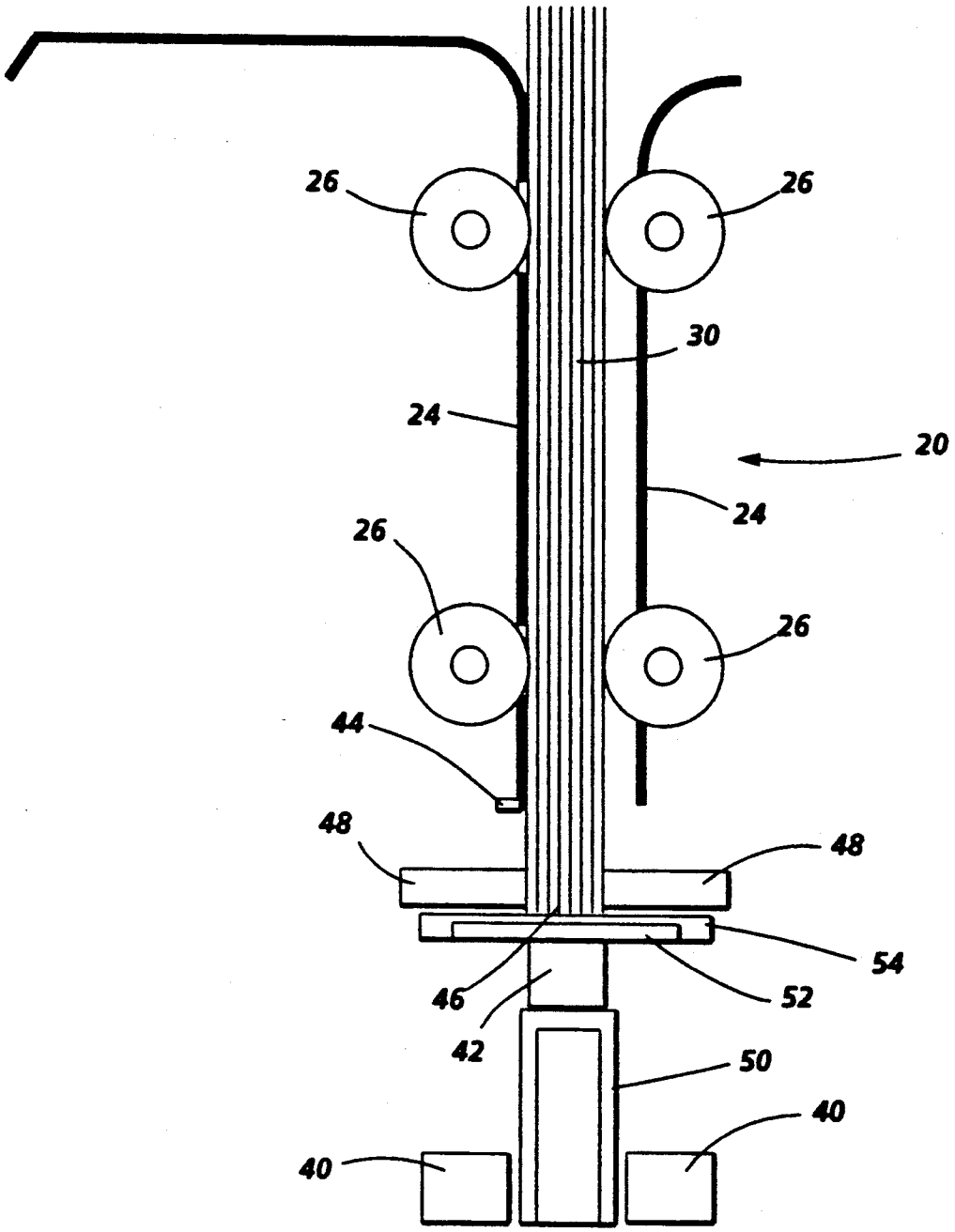
FIG. 8 is schematic elevational view illustrating the binding apparatus positioning an adhesive strip on the spine of the set of copy sheets.

Referring now to FIG. 8, while transport 20 raises the set of copy sheets 30, flappers 40 lower in preparation for receiving the adhesive tape. A tape feed, driven by a step motor, controls the tape size for the bind. The motor advances a length of tape corresponding to the length of the copy sheet edge having the tape applied thereon. The tape is then fed into tape guide 54 and, cut to size, and positioned in tape guide 54. Tape guide 54 is then moved over platen 42 and flappers 40. At this time calipers 48 press against the sides of the sets of copy sheets.

Figure 9:
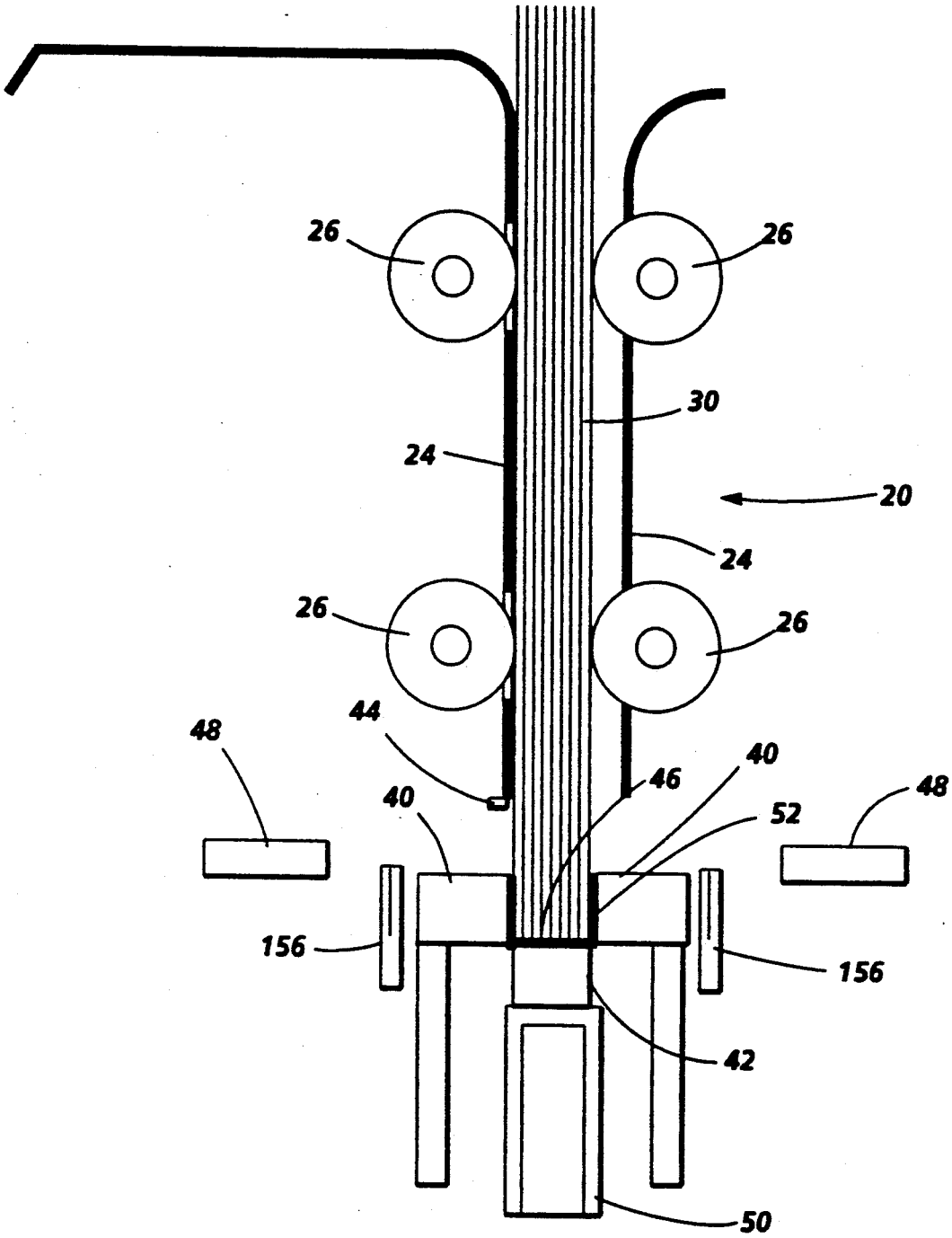
FIG. 9 is a schematic elevational view showing the binding apparatus bending the sides of the adhesive strip into contact with opposed sides of the outermost sheets of the set of copy sheets.

Turning now to FIG. 9, stop 44 is shown in the second position further from the surface of platen 42. Platen 42 and flappers 40 are heated to soften the adhesive. After the tape is positioned over the platen and flappers, the motion of tape guide 54 moves stop 44 upwardly to the second position. In the second position, stop 44 engages the lower end of transport 20 with edge 46 of set 30 pressed into the softened adhesive on tape 52 a distance sufficient to form a layer of adhesive having a thickness of about 0.254 mm between edge 46 and the surface of tape 52 opposed therefrom. Another sensor, preferably a light emitting diode or photodiode, detects when the end of transport 20 engages stop 44 and de-energizes the motor moving transport 20 downwardly. Thus, after stop 44 is positioned in the second position, transport 20 moves in a downwardly direction until the end of transport 20 contacts stop 44 to press spine 46 into the softened adhesive on tape 52. Stop 44 is located in the second position so that a layer of adhesive having a thickness of about 0.254 mm is formed between the spine or end 46 and the surface of tape 52 opposed therefrom. Calipers 48 are disengaged from the set of copy sheets and flapper 40 moves in a vertically upward direction to bend tape 52 so that the adhesive sides thereof press against the opposed outermost sheets of the set of copy sheets. Preferably, flappers 40 and platen 42 are heated to about 265° F. and 425° F., respectively, to thermally activate and soften the adhesive on tape 52. In this way, the adhesive tape is fixed to the spine of the set of copy sheets with the layer of adhesive being formed between the spine and the surface of the tape opposed therefrom. Any suitable adhesive tape known in the binding art may be employed. One such adhesive tape described in U.S. Pat. No. 3,847,718, the relevant portions thereof being hereby incorporated into the present application by reference thereto. After the adhesive tape is applied on the spine of the set of copy sheets, the flappers are retracted and the transport moves in a vertically upward direction to space the bound set of copy sheets from platen 42. Transport 20 then rotates 90° in a counter-clockwise direction to position the set of copy sheets in a substantially horizontal orientation. Plates 24 then move in a direction opposed from one another and rollers 26 eject the bound set of copy sheets into receiving station 18.

Figure 10:
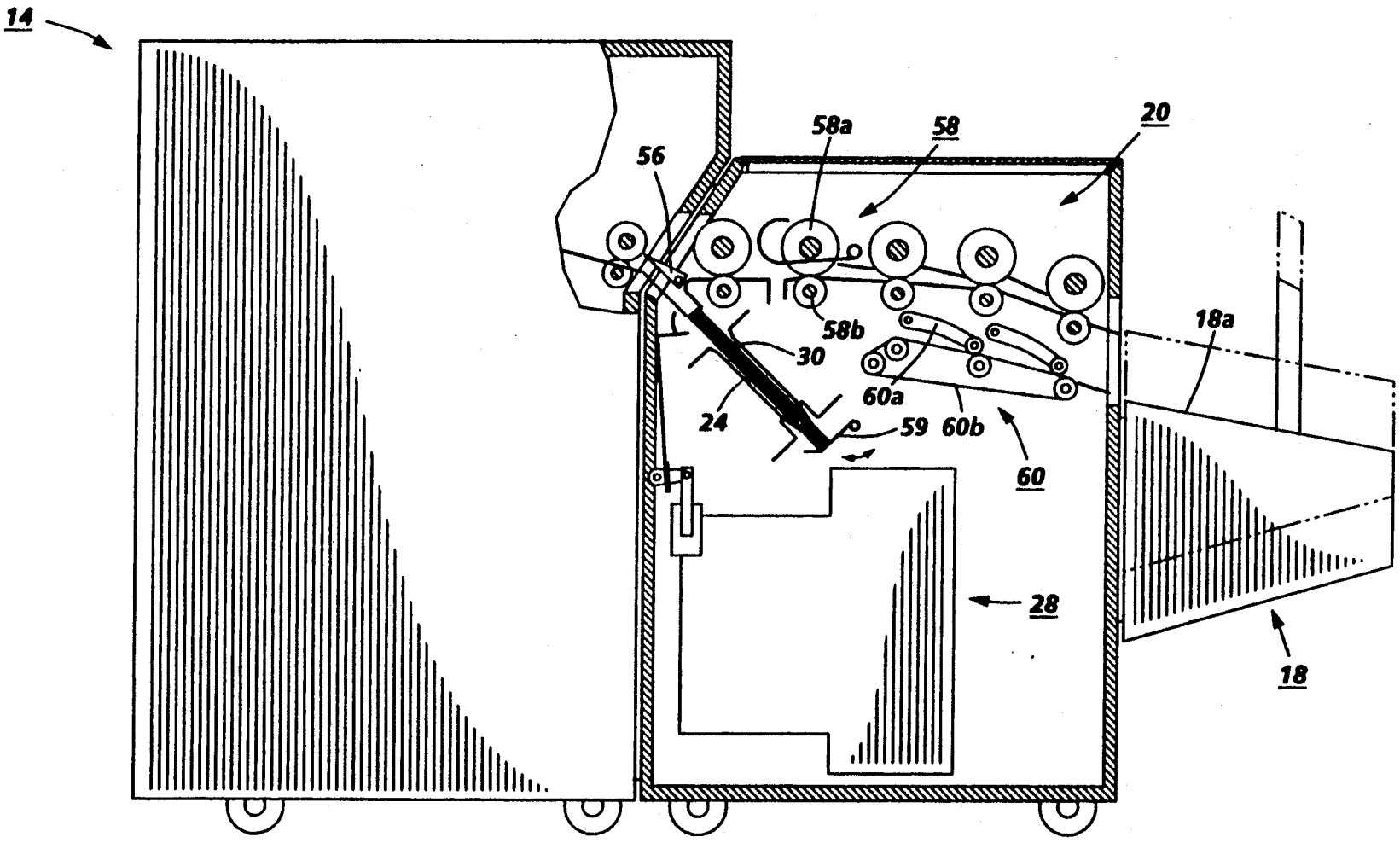
FIG. 10 shows another embodiment of the transport of the binding apparatus.

Turning now to FIG. 10, there is shown another embodiment of transport 20. As depicted thereat, tilt bed or plates 24 are positioned so as to receive the set of sheets 30 from compiler 14. The set of sheets is directed along the correct path by gate 56. The set of sheets advances between plates 24 until the lead edge thereof engages stop 59. The plates than clamp the set of sheets therebetween and the stop 59 pivots to a remote, non-operative position. Plates 24 than pivot the set of sheets clockwise to position the set of sheets vertically as shown in FIG. 10. Transport 20 includes an upper transport 58 and a lower transport 60. Upper transport 58 includes an upper set of feed rolls 58*a* and a lower set of feed rolls 58*b*. Rolls 58*a* and 58*b* engage one another to define a nip through which the set of sheets may be advanced. Lower transport 60 includes an upper set of conveyors 60*a* and a lower conveyor 60*b*. Receiving station or elevator 18 is adapted to have the receiving surface 18*a* thereof aligned with the output of either upper transport 58 or lower transport 60.

Figure 11:
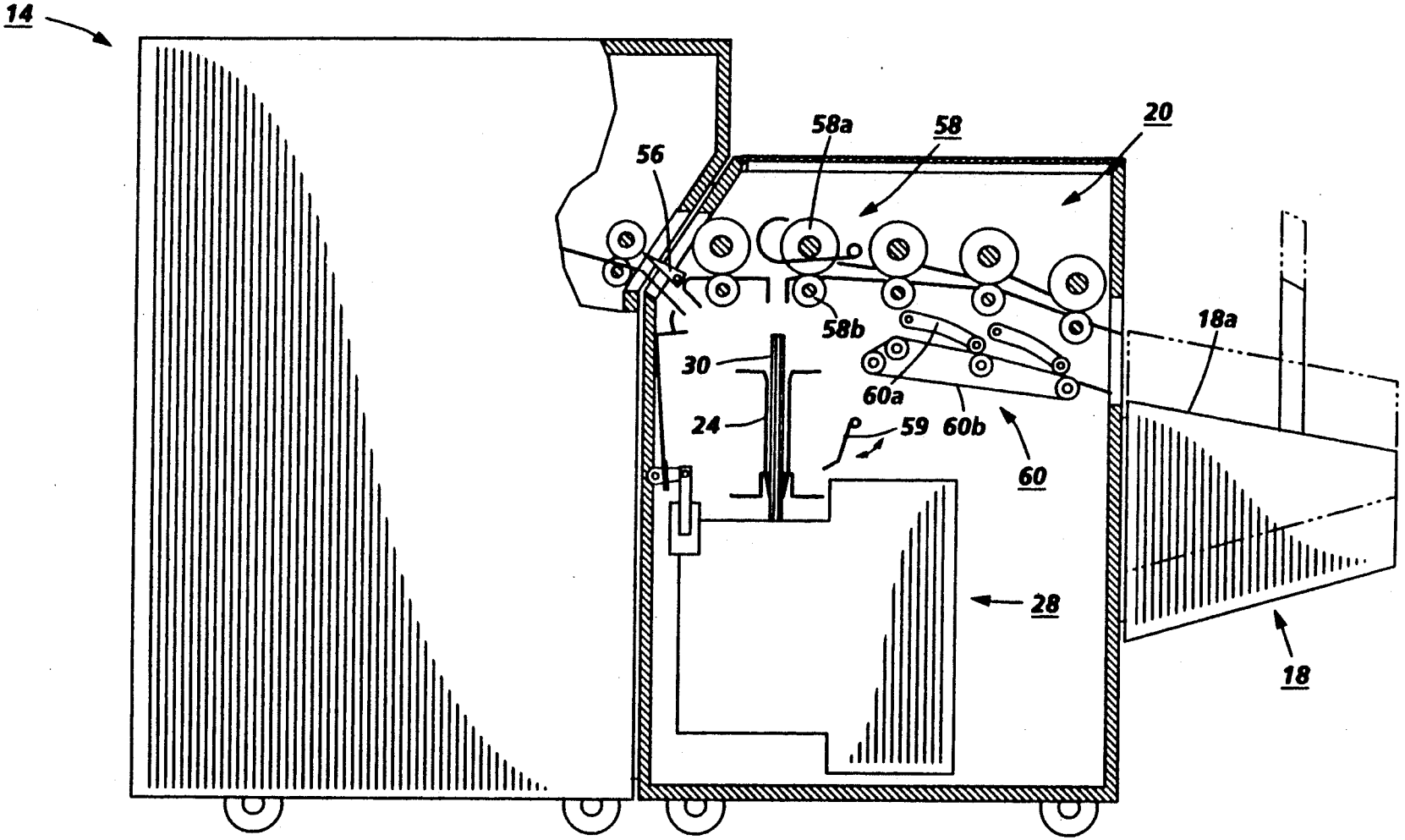
FIG. 11 shows the FIG. 10 transport advancing the set of sheets into the binding apparatus.

Referring now to FIG. 11, there is shown tilt bed 24 oriented vertically to advance set of sheets 30 into binding apparatus 28. In this position, the set of sheets are bound in the manner previously described with reference to FIGS. 7 through 9, inclusive. After the binding operation is completed, the tilt bed 24 moves upwardly and pivots to the position shown in FIG. 12 where the plates 24 unclamp and release the set of sheets 30.

Figure 12:
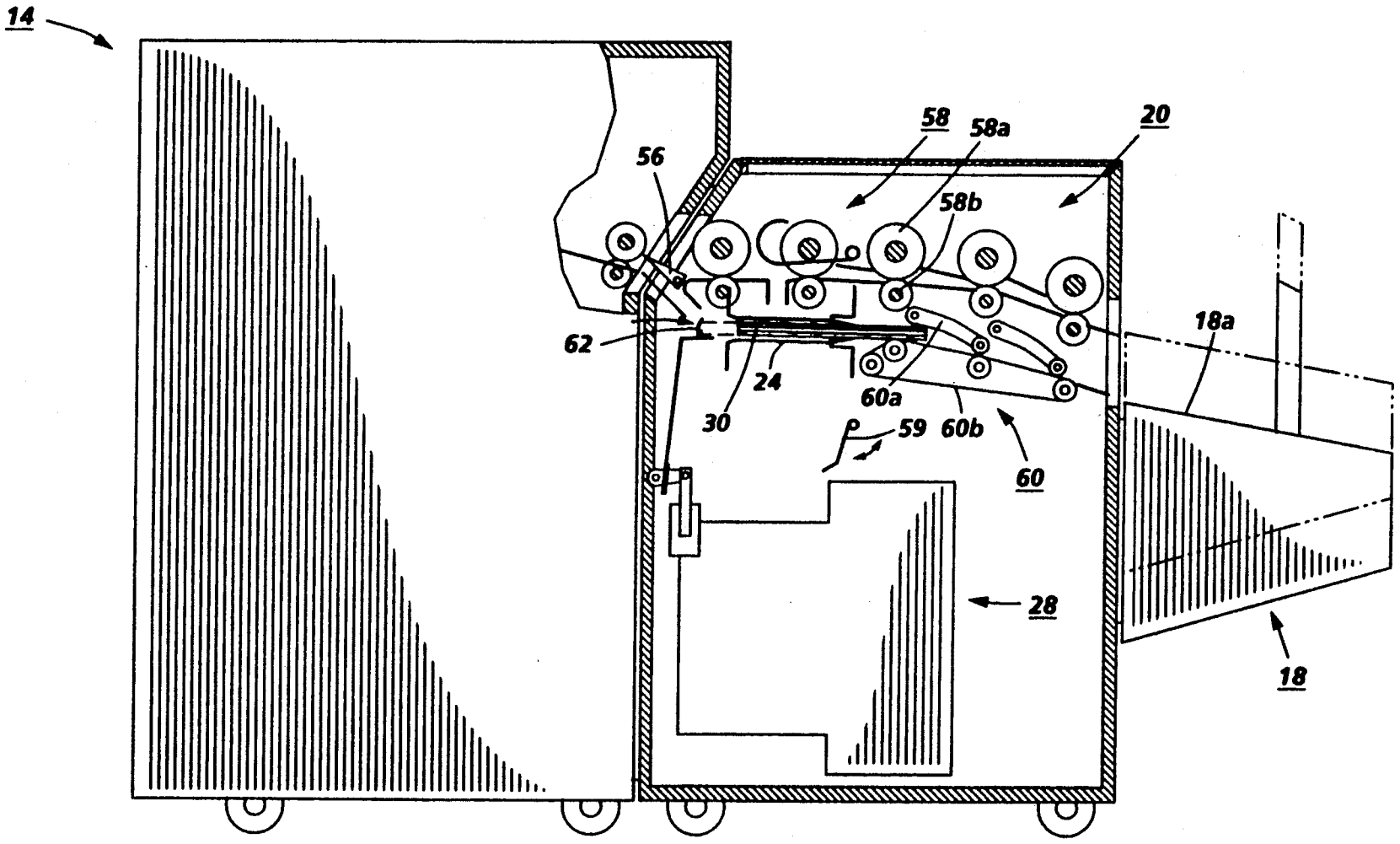
FIG. 12 shows the FIG. 10 transport advancing the bound set of sheets to output tray.

As shown in FIG. 12, pushing arm 62, i.e. a solenoid actuated arm pushes the released set of sheets into lower transport 60. Lower transport 60 advances the bound set of sheets onto surface 18*a* of elevator 18 for removal by the machine operator.

Figure 13:
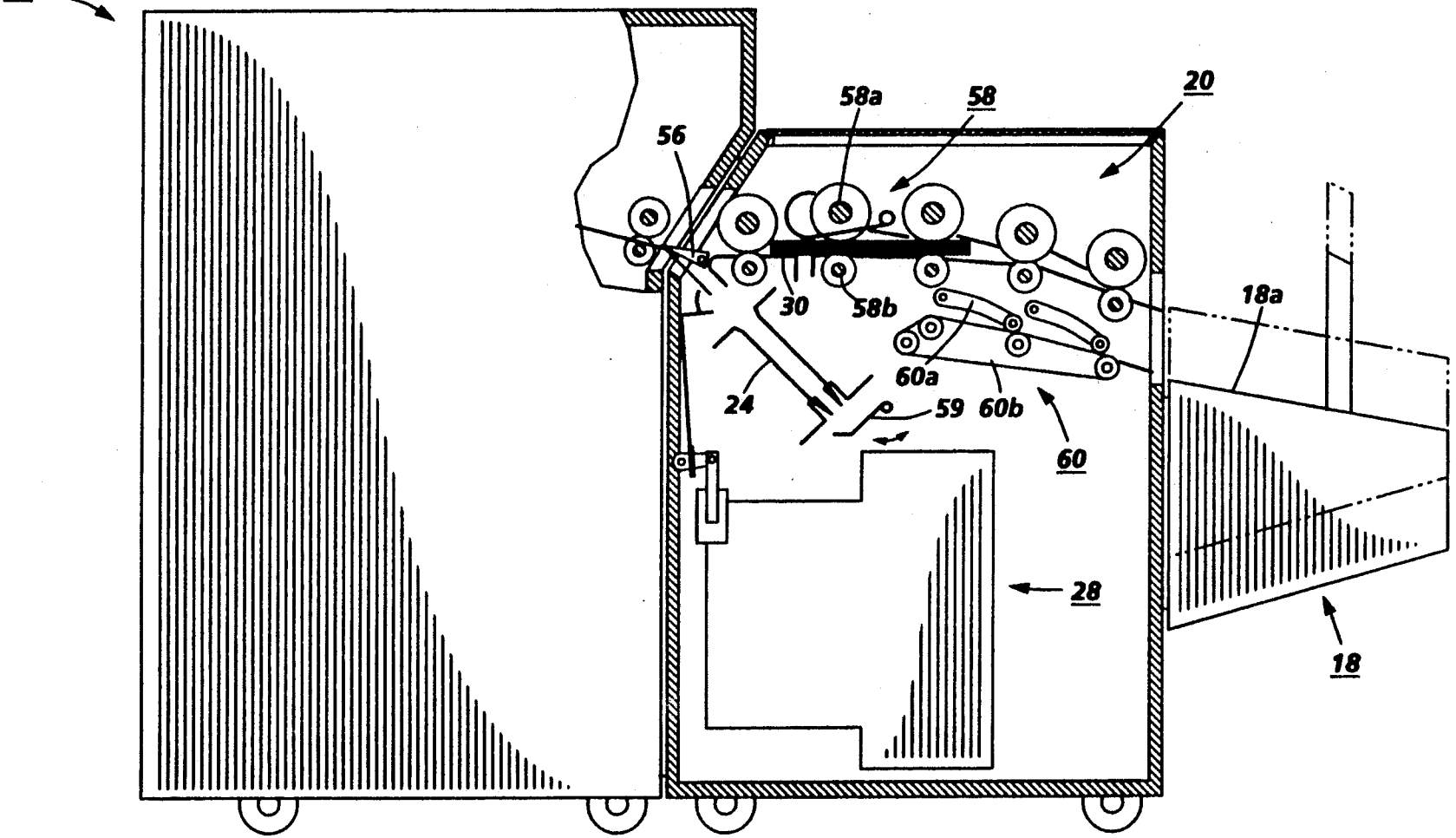
FIG. 13 shows the FIG. 10 transport arranged so that the set of sheets by-passes the binding apparatus.

FIG. 13 shows an alternate mode operation wherein gate 56 is pivoted so as to guide the set of sheets into upper transport 58. This is the by-pass mode of operation wherein a stapled or unstapled set of sheets are directed into the upper transport 58 and advanced over binding apparatus 28 onto surface 18*a* of elevator 18. In this mode of operation, elevator 18 has moved upwardly to position surface 18*a* thereof in position adjacent the output of transport 58 for receiving the set of sheets. Preferably roller 58*a* of transport 58 are a series of soft foam drive rollers of large diameter so that a wide range of set thicknesses can be accommodated. One skilled in the art will appreciate that other types of transports capable of transporting sets such as a belt-on-belt or simple conveyor could also be used.

Figure 14:
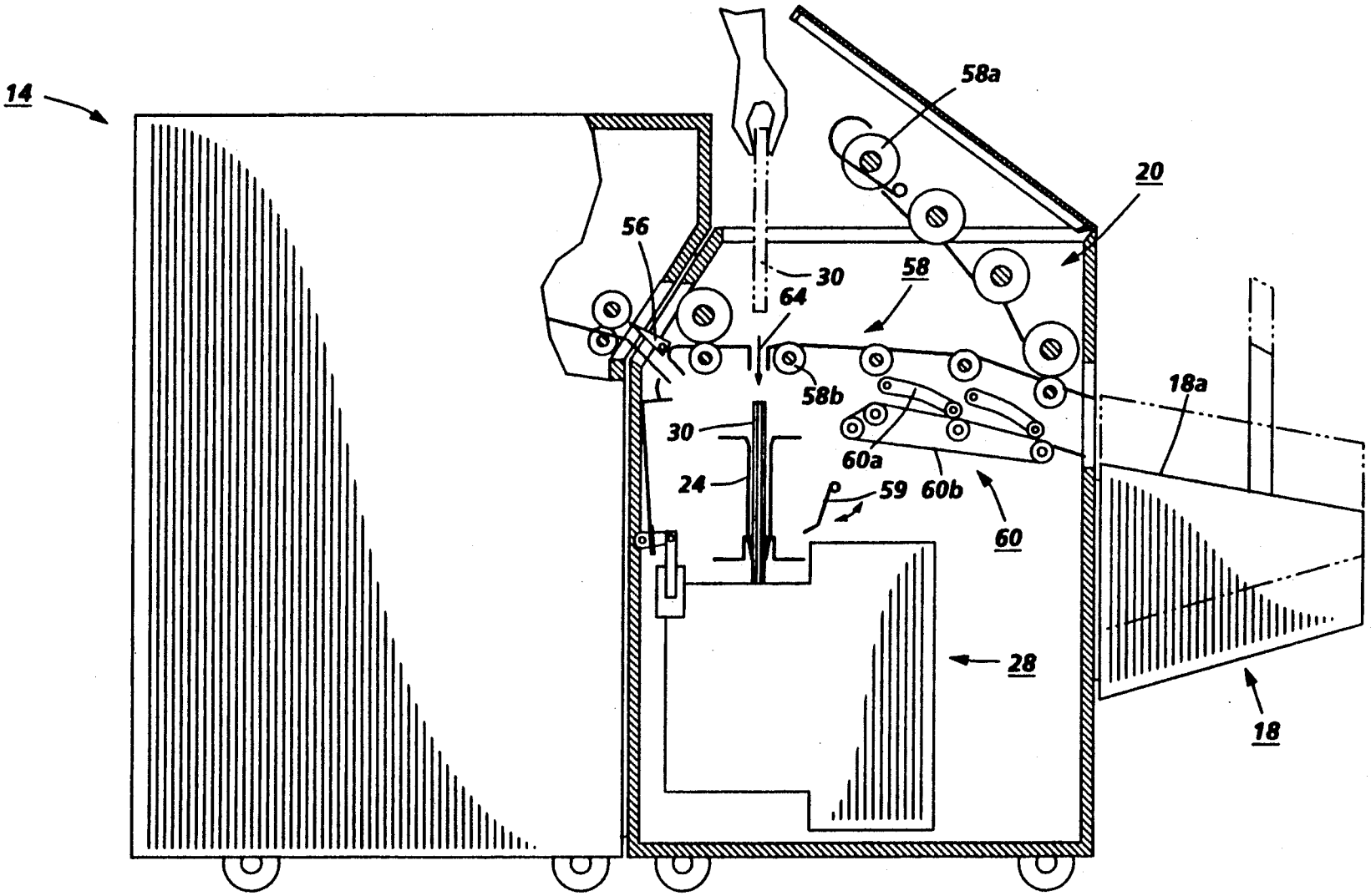
FIG. 14 shows the FIG. 10 transport arranged so that the set of sheets is manually fed into the binding apparatus.

Turning now to FIG. 14, there is shown transport 20 arranged to permit the manual feeding of a set of sheets into binding apparatus 28. As depicted thereat, upper rollers 58*a* of upper transport 58 are pivoted upwardly in a clockwise direction to provide access to input slot 64 in the supports for lower rollers 58*b*. In this way, the operator manually inserts a set of sheets 30 through slot 64 between the plates of the tilt bed 24. The set of sheets are then advanced into binding apparatus 28 in the manner herinbefore described.

In recapitulation, the set of sheets is advanced from a compiling station to a binding station or a receiving station. The transport adapted to advance the set of sheets is movable from a non-operative position coupling the compiling station to the receiving station to an operative position where the transport is adapted to advance the set of sheets from the compiling station to a binding station. In addition, a set of sheets may be manually inserted into the transport for advancement to the binding apparatus and subsequently therefrom to the receiving station.

It is, therefore, evident that there has been provided, in accordance with the present invention, a binding apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus for securing sheets of a set of sheets to one another, including:

a compiling station holding an unbound set of sheets;

means for binding the sheets of the unbound set of sheets to one another to form a bound set of sheets;

a receiving station adapted to receive an unbound or bound set of sheets for removal therefrom; and means for advancing the unbound set of sheets from said compiling station to said binding means and said receiving station, said advancing means being movable from a position, coupling said compiling station to said receiving station to a position coupling said compiling station to said binding means, and to a position coupling said binding means to said receiving station so as to advance an unbound set of sheets from said compiling means to said binding means and a bound set of sheets from said binding means to said receiving station, or an unbound set of sheets from said compiling means to said receiving station.

2. An electrophotographic printing machine of type in which successive copy sheets are compiled into set and the sheets of each set are bound together, wherein the improvement includes:

a compiling station holding an unbound set of copy sheets;

means for binding the copy sheets of the unbound set of copy sheets to one another to form a bound set of copy sheets;

a receiving station adapted to receive sets of copy sheets for removal therefrom; and means for advancing the set of copy sheets from said compiling station to said binding means and said receiving station, said advancing means being movable from a position, coupling said compiling station to said receiving station, to a position coupling said compiling station to said binding means, and to a position coupling said binding means to said receiving station so as to advance an unbound set of copy sheets from said compiling means to said binding means and a bound set of copy sheets from said binding means to said receiving station or an unbound set of copy sheets from said compiling means to said receiving station.

3. An apparatus for securing sheets of a set of sheets to one another, including:

a compiling station holding an unbound set of sheets;

means for binding the sheets of the unbound set of sheets to one another to form a bound set of sheets;

a receiving station adapted to receive an unbound or bound set of sheets for removal therefrom;

means for advancing the unbound set of sheets from said compiling station to said binding means and said receiving station, said advancing means being movable from a position coupling said compiling station to said receiving station, to a position coupling said compiling station to said binding means, and to a position coupling said binding means to said receiving station, so as to advance an unbound set of sheets from said compiling means to said binding means and a bound set of sheets from said binding means to said receiving station, or an unbound set of sheets from said compiling means to said receiving station; and a manual insertion station located at the position wherein said advancing means couples said compiling station to said receiving station enabling a set of sheets to be inserted into said advancing means, said advancing means being adapted to advance the manually inserted set of sheets to said binding means which binds the manually inserted set of sheets to one another.

4. An apparatus according to claim 3, wherein said binding means includes:

means for applying a strip having adhesive on one surface thereof to one edge of the set of sheets;

means for supporting and heating the strip to soften the adhesive thereon;

means for moving said supporting means and the set of sheets relative to one another so as to press one edge of the set of sheets into the adhesive on the strips; and means for controlling the depth of penetration of said one edge of the set of sheets into the adhesive on the strip so as to form a layer of adhesive between said one edge of the set and strip having a predetermined thickness.

5. An apparatus according to claim 4, wherein said supporting means is stationary.

6. An apparatus according to claim 5, wherein said supporting means includes a heated platen defining a generally planar substantially horizontal support surface.

7. An apparatus according to claim 6, wherein said moving means orients the set of sheets substantially vertically and moves the set of sheets in a downward direction.

8. An apparatus according to claim 7, wherein said controlling means limits the movement of said moving means to regulate the depth of penetration of said one edge of the set of sheets into the adhesive on the strip.

9. An apparatus according to claim 8, further including a pair of heated side guides arranged to be normally spaced from the set of sheets and being movable to fold the sides of the strip into contact with opposed outer sheets of the set of sheets and heat the sides of the strip to fix the sides of the strip to the opposed outer sheets of the set of sheets.

10. An electrophotographic printing machine of the type in which successive copy sheets are compiled into sets and the sheets of each set are bound together, wherein the improvement includes:

a compiling station holding an unbound set of copy sheets;

means for binding the copy sheets of the unbound set of copy sheets to one another to form a bound set of copy sheets;

a receiving station adapted to receive sets of copy sheets for removal therefrom;

means for advancing the set of copy sheets from said compiling station to said binding means and said receiving station, said advancing means being movable from a position coupling said compiling station to said receiving station, to a position coupling said compiling station to said binding means, and to a position coupling said binding means to said receiving station so as advance an unbound set of copy sheets from said compiling means to said binding means and a bound set of copy sheets from said binding means to said receiving station or an unbound set of copy sheets from said compiling means to said receiving station; and a manual insertion station located at the position wherein said advancing means couples said compiling station to said binding means enabling a set of copy sheets to be inserted into said advancing means, said advancing means being adapted to advance the manually inserted set of sheets to said binding means which binds the manually inserted set of sheets to one another.

11. A printing machine according to claim 10, wherein said binding means includes:

means for applying the strip having adhesive on one surface thereof to one edge of the set of copy sheets;

means for supporting and heating the strip to soften the adhesive thereon;

means for moving said supporting means and the set of sheets relative to one another so as to press one edge of the set of sheets into the adhesive on the strip; and means for controlling the depth of penetration of said one edge of the set of sheets into the adhesive on the strip so as to form a layer of adhesive between said one edge of the set and the strip having a predetermined thickness.

12. A printing machine according to claim 11, wherein said supporting means is stationary.

13. A printing machine according to claim 12, wherein said supporting means includes a heated platen defining a generally planar, substantially horizontal support surface.

14. A printing machine according to claim 13, wherein said moving means orients the set of sheets substantially vertically and moves the set of sheets in a downward direction.

15. A printing machine according to claim 14, wherein said controlling means limits the movement of said moving means to regulate the dept of penetration of said one edge of the set of sheets into the adhesive on the strip.

16. A printing machine according to claim 15, further including a pair of heated side guides arranged to be normally spaced from the set of sheets and being movable to fold the sides of the strip into contact with opposed outer sheets of the set of sheets and heat the sides of the strip to fix the sides of the strip to the opposed outer sheets of the set of sheets.

* * * * *